US007670264B2

(12) United States Patent
Davis

(10) Patent No.: US 7,670,264 B2
(45) Date of Patent: Mar. 2, 2010

(54) INTEGRATED BODY CONDITIONING EXERCISE SYSTEM

(75) Inventor: William Jackson Davis, Gualala, CA (US)

(73) Assignee: The Miracle Workout LLC., Boulder, CO (US)

( * ) Notice: Subject to any disclaimer, the term of this patent is extended or adjusted under 35 U.S.C. 154(b) by 1323 days.

(21) Appl. No.: 11/050,319

(22) Filed: Feb. 2, 2005

(65) Prior Publication Data

US 2006/0172859 A1 Aug. 3, 2006

(51) Int. Cl.
*A63B 71/00* (2006.01)

(52) U.S. Cl. ..... 482/8; 482/1; 482/9; 601/23

(58) Field of Classification Search ..... 482/1–9, 482/900–902, 51, 54; 601/23; 434/247
See application file for complete search history.

(56) References Cited

U.S. PATENT DOCUMENTS

| | | | | |
|---|---|---|---|---|
| 4,688,789 | A | 8/1987 | Alter | |
| 4,925,185 | A | 5/1990 | Gongwer et al. | |
| 5,092,583 | A * | 3/1992 | Rudolf | 482/82 |
| 5,692,996 | A * | 12/1997 | Widerman | 482/93 |
| 5,839,997 | A * | 11/1998 | Roth et al. | 482/107 |
| 6,626,800 | B1 | 9/2003 | Casler | |
| 6,656,096 | B2 | 12/2003 | Sela | |

* cited by examiner

*Primary Examiner*—Glenn Richman
(74) *Attorney, Agent, or Firm*—Adam W. Bell

(57) ABSTRACT

The Integrated Body Conditioning (IBC) exercise system is a method of exercising employing three defining elements: integration of aerobic, resistance, and Range of Motion exercises performed at a properly elevated heart rate with exercise intensity and duration adjusted in view of biofeedback data.

11 Claims, 15 Drawing Sheets

The 3-Step Advanced IBC Program (Preferred Embodiment)

*1. Prerequisites.* Excellent physical condition, low cardiovascular risk category or medical clearance. Recommended: Health and medical history, current medical exam, doctor-supervised maximal exercise test.

*2. Intensity.* Prolonged vigorous exercise.

*3. Description.* 3 steps; 2 preparatory and 1 integrated.

Step 1: Cardio (preparatory)

*1. Goal.* 60 minutes of vigorous cardio exercise in complete comfort.

*2. Method.* Self-paced, progressive aerobic (cardio) exercise.

*3. Time.* 60 minutes per workout, 3 workouts per week, 2 - 4 weeks.

Step 2: Cardiorom (preparatory, partially integrated)

*1. Goal.* Integration of ROM with prolonged vigorous cardio exercise.

*2. Method.* Alternate vigorous cardio and ROM exercise.

*3. Time.* 60 minutes per workout, 3 workouts per week, 2 - 4 weeks.

Step 3: Cardiolift (fully integrated)

*1. Goal.* Integration of weightlifting with prolonged vigorous cardio exercise followed by ROM cool-down.

*2. Method.* Alternate cardio and weightlifting exercise with a terminal ROM cool-down.

*3. Time.* 90 minutes or more per workout, 2 - 3 workouts per week, indefinite to cross-training, periodization, or taper for sport season.

The 3-Step Advanced IBC Program (Preferred Embodiment)

*1. Prerequisites.* Excellent physical condition, low cardio-vascular risk category or medical clearance. Recommended: Health and medical history, current medical exam, doctor-supervised maximal exercise test.

*2. Intensity.* Prolonged vigorous exercise.

*3. Description.* 3 steps; 2 preparatory and 1 integrated.

Step 1: Cardio (preparatory)

*1. Goal.* 60 minutes of vigorous cardio exercise in complete comfort.

*2. Method.* Self-paced, progressive aerobic (cardio) exercise.

*3. Time.* 60 minutes per workout, 3 workouts per week, 2 - 4 weeks.

Step 2: Cardiorom (preparatory, partially integrated)

*1. Goal.* Integration of ROM with prolonged vigorous cardio exercise.

*2. Method.* Alternate vigorous cardio and ROM exercise.

*3. Time.* 60 minutes per workout, 3 workouts per week, 2 - 4 weeks.

Step 3: Cardiolift (fully integrated)

*1. Goal.* Integration of weightlifting with prolonged vigorous cardio exercise followed by ROM cool-down.

*2. Method.* Alternate cardio and weightlifting exercise with a terminal ROM cool-down.

*3. Time.* 90 minutes or more per workout, 2 - 3 workouts per week, indefinite to cross-training, periodization, or taper for sport season.

Figure 1

ADVANCED MIRACLE WORKOUT LOG, CARDIOLIFT PHASE, PRESCRIBED

Name _____

Cardiovascular Parameters and Heart Rate Training Window

Active Rest_____ BPM (40% HRR) Lower _____ BPM (60% HRR) Upper _____ BPM (84% HRR) Target _____ BPM (72% HRR)

| WORKOUT # ____ | | WORKOUT # ____ | | WORKOUT # ____ | |
|---|---|---|---|---|---|
| Date (m/d/y) | Day of Week | Date (m/d/y) | Day of Week | Date (m/d/y) | Day of Week |
| | | | | | |

CARDIOVASCULAR CONDITIONING

| Cardiovascular (Check) | Time (min) | Progam | Level | KCals/ Av HR | Time (min) | Program | Level | KCals/ Av HR | Time (min) | Program | Level | KCals/ AvHR |
|---|---|---|---|---|---|---|---|---|---|---|---|---|
| Stair Stepper ☐ | | | | | | | | | | | | |
| Treadmill ☐ | | | | | | | | | | | | |
| Cycle ☐ | | | | | | | | | | | | |
| Other ☐ | | | | | | | | | | | | |

FREE WEIGHTS AND EXERCISE MACHCINES

| Exercise | wt, lbs | rep 8-12 | sets (3) | RPP | RPE | wt, lbs | rep 8-12 | sets (3) | RPP | RPE | wt, lbs | rep 8-12 | sets (3) | RPP | RPE |
|---|---|---|---|---|---|---|---|---|---|---|---|---|---|---|---|
| 1. Leg Press | | | | | | | | | | | | | | | |
| 2. Leg Extension | | | | | | | | | | | | | | | |
| 3. Leg Flexion | | | | | | | | | | | | | | | |
| 4a. Hip Flexion | | | | | | | | | | | | | | | |
| 4b. Hip Extension | | | | | | | | | | | | | | | |
| 4c. Hip Abduction | | | | | | | | | | | | | | | |
| 4d. Hip Adduction | | | | | | | | | | | | | | | |
| 5. Lat Pull-Downs | | | | | | | | | | | | | | | |
| 6. Bench Press | | | | | | | | | | | | | | | |
| 7. Overhead Press | | | | | | | | | | | | | | | |
| 8. Arm Curls | | | | | | | | | | | | | | | |
| 9. Triceps Extens. | | | | | | | | | | | | | | | |
| 10. Core (Abs) | | | | | | | | | | | | | | | |

OVERALL WORKOUT PARAMETERS

| | | | |
|---|---|---|---|
| WinTim/Av. HR/Kcal | / / | / / | / / |
| Weight Before/After | / | / | / |
| Water Used (liters) | | | |
| Workout RPP/RPE | / | / | / |
| Observations & Comments | | | |

Do not use this Workout Log without following the information and safety guidelines contained in the book *The Miracle Workout*. The Miracle Workout, and its agents, assume no liability for persons who use this Workout Log or change their exercise or physical activity. Copyright 2002, W. Jackson Davis. This Workout Log may be reproduced without change for personal use only.

Figure 2

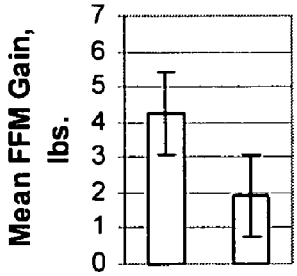
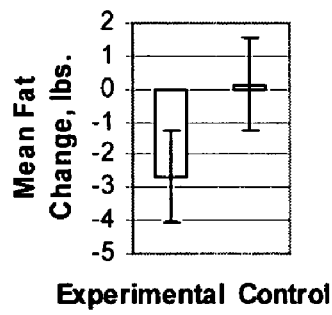
Figure 6

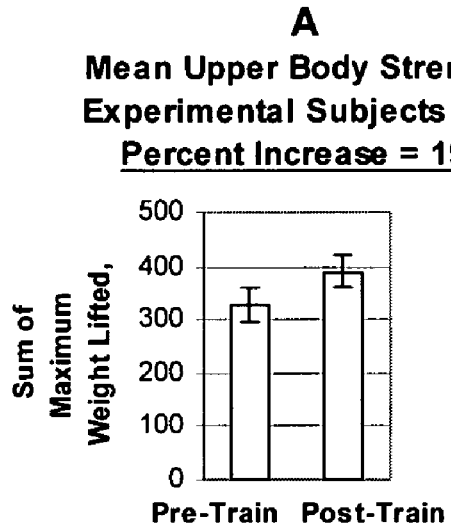
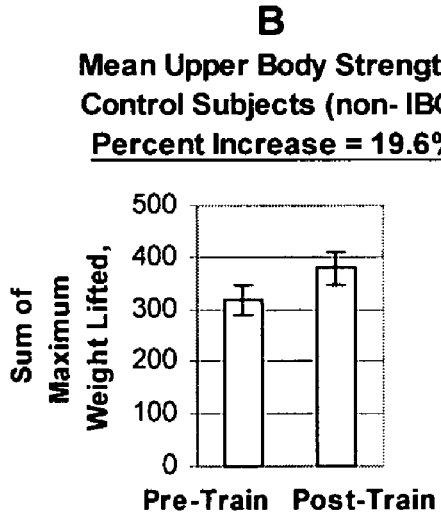
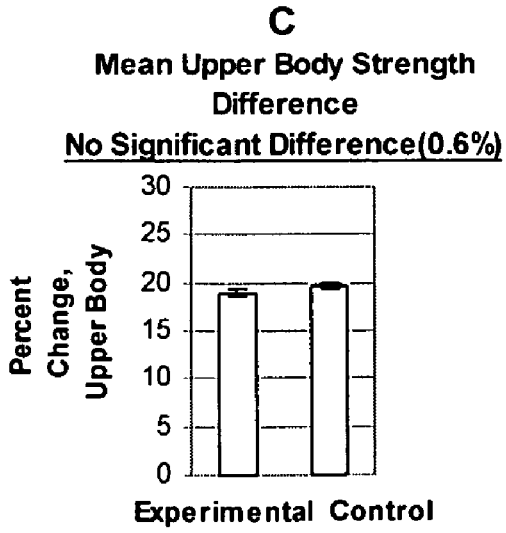
Figure 10

INTEGRATED BODY CONDITIONING EXERCISE SYSTEM

BACKGROUND

The relationship between exercise and, health has been known from time immemorial. Hippocrates (460-370 B.C.) is believed to have said "If we could give every individual the right amount of nourishment and exercise, not too little and not too much, we would have found the safest way to health." In modern times, with the advent of industrialized society, people's lives have become less physically active and demanding. In recent years, with the development of the information economy and the computer, we are becoming more and more sedentary. This, combined with the increased processing of foods, provides the average American or European with a lifestyle marked by poor nutrition and insufficient exercise. As a consequence, obesity has become the number one cause of premature death of people both in the United States and also globally, with heart disease a close second.

When done properly, exercise can increase muscle and bone strength, endurance, aerobic capacity, cardiovascular and cardiopulmonary health, metabolic health, the ratio of fat to muscle (body composition), and body flexibility. These benefits result in higher quality of life, reduced probability of injury, enhanced mental function, improved mood, and increased longevity. Various general modes of exercise are well known and widely practiced, including aerobics, resistance (weightlifting), and Range of Motion exercise (bending and stretching). Several variants involving one or the other of these general types have been developed, including interval exercising, circuit training, isometric exercises etc.

A number of patent disclosures describe exercise routines. Some representative examples are as follows.

U.S. Pat. No. 6,626,800 describes an exercise method that can be modified by a clinician. A processor with a protocol-generating algorithm is used in communication with an exercise device. Data is entered into the processor, such as age, height, weight and sex, and the processor generates an exercise protocol according to a protocol-generating algorithm and the user data. A supervisor is then capable of reviewing and modifying the exercise protocol. This protocol is then transferred to an exercise device having sensors that monitor the performance of the user.

U.S. Pat. No. 4,925,185 describes an exercise method which provides increased heart rates and respiration while introducing variable resistance to the exercise through a combination of muscular resistance aided by mechanical force transference. The invention uses a force transfer device to transfer the force resulting from the extension or flexion of one muscle to a force resisting the extension or flexion of another muscle.

U.S. Pat. No. 4,688,789 describes a method of exercise that enables the user to exercise both the arms and the legs simultaneously.

U.S. Pat. No. 6,656,096 describes a method for strengthening coordination between a person's hand muscles and muscles of the lower part of a person's body.

BRIEF DESCRIPTION OF INVENTION

The Integrated Body Conditioning (IBC) exercise method entails a unique combination of three exercise elements, distinguishing it from all other approaches to and forms of exercise.

1. Integrated Exercise—the exerciser performs all three major classifications of exercise (cardio, resistance, ROM) in a prescribed sequence during every exercise session (workout).
2. Elevated Heart Rate—the individual exercises at a properly elevated heart rate, embodying a new principle of exercise termed Cardio-Driving. The correct heart rate window is prescribed based on the exerciser's health, initial physical condition, and exercise goals.
3. Progression Based on Biofeedback—exercise volume and intensity increase from one workout to the next, depending on three forms of biofeedback: heart rate, Rating of Perceived Exertion (RPE), and Rating of Perceived Pain (RPP).

Exercisers approach the fully integrated IBC workout in three defined steps:

Step 1: Cardio—self-paced, progressive aerobic exercise (1-4 weeks).

Step 2: Cardiorom—alternated cardio and Range of Motion (ROM) exercise (1-4 weeks).

Step 3: Cardiolift—alternated cardio and weightlifting exercise followed by a ROM cool-down (indefinitely to cross-training, periodization, or transition to a higher level).

The form and duration of these three steps vary for the beginning, intermediate, and advanced IBC workout and depending on the exercisers initial health, physical conditioning, and exercise goals.

The exerciser uses an optional Workout Log (FIG. 2) designed in part to record various measurements of biofeedback assessed during the workout. This biofeedback information determines the rate of progression from one workout to the next. The biofeedback also enables the exerciser to monitor development, identify and break plateaus, and increase exercise motivation and adherence.

Biofeedback is defined as "body signals made conscious." The term is generally used to describe quantitative or semi-quantitative data perceived by a subject that corresponds to a physiological or psychological parameter of the subject. So, for example, biofeedback may include heart rate, body temperature, respiratory rate or perceived emotional state etc.

The IBC workout produces unexpected and vastly superior results in comparison with the best extant drug-free exercise prescription, as documented by controlled, randomized, and double-blind scientific trials (FIGS. 3-15).

In its simplest embodiment, the Integrated Body Conditioning method comprises the following steps, each repeated for three times per week over a period of 2-4 weeks.

Step 1: about 60 minutes of self-paced, progressive aerobic exercise

Step 2: about 60 minutes of alternated vigorous cardio and ROM exercise

Step 3: about 90 minutes of alternated cardio and weightlifting exercise followed by a terminal ROM cool-down step At every stage exercise duration and intensity is changed from one workout to the next in view of biofeedback measurements for heart rate, Rating of Perceived Exertion (RPE), and Rating of Perceived Pain (RPP).

The duration of each exercise step given above is approximate and may vary by plus or minus about 50% of the stated time, depending on the individual. For example, in various embodiments, any of the above steps may last for about 40, 60, 80, 100 or 120 minutes.

The beginning level IBC exercise is generally performed as follows:

Step 1: a cardio step comprising between 20 to 40 minutes of moderate aerobic exercise completed in complete comfort, wherein "complete comfort" is defined on the basis of self-assessed biofeedback, and requires that the Rating of Perceived Exertion is no greater than "strong," and Rating of Perceived Pain is no greater than "weak," during the exercise session;

Step 2: a cardiorom step comprising a plurality of short repeated bouts of aerobic exercise (0.5-2 minutes) followed by bending and stretching exercise, followed by ROM exercise, wherein heart rate is continually within the training window, wherein the elements of step 2 are repeated over a period of between 20 and 40 minutes, and wherein step 2 is repeated until step 2 can be accomplished in "complete comfort," based on biofeedback, whereupon step 3 may then be undertaken;

Step 3: a cardiolift step comprising a warm-up followed by alternating aerobic exercise and weightlifting exercise, wherein for the weightlifting exercise 1 to 8 weightlifting exercises are performed, using 1 or more sets per weightlifting exercise, and 1 to 20 repetitions per set followed by a ROM cool-down step.

The intermediate level IBC exercise is generally performed as follows:

Step 1: a cardio step comprising between 30 to 50 minutes of moderate aerobic exercise completed in complete comfort, wherein "complete comfort" is defined on the basis of self-assessed biofeedback, and requires that the Rating of Perceived Exertion is no greater than "strong," and Rating of Perceived Pain is no greater than "weak," during the exercise session;

Step 2: a cardiorom step comprising a plurality of short repeated bouts of aerobic exercise (0.5-2 minutes) followed by bending and stretching exercise, followed by ROM exercise, wherein heart rate is continually within the training window, wherein the elements of step 2 are repeated over a period of between 40 and 60 minutes, and wherein step 2 is repeated until step 2 can be accomplished in "complete comfort," based on biofeedback, whereupon step 3 may then be undertaken;

Step 3: a cardiolift step lasting from 50 to 70 minutes, comprising a warm-up followed by alternating aerobic exercise and weightlifting exercise, wherein for the weightlifting exercise 8 to 12 weightlifting exercises are performed, using 2 or more sets per weightlifting exercise, and 1 to 20 repetitions per set followed by a ROM cool-down step.

The advanced level IBC exercise is generally performed as follows:

Step 1: a cardio step comprising between 50 to 70 minutes of vigorous aerobic exercise completed in complete comfort, wherein "complete comfort" is defined on the basis of self-assessed biofeedback, and requires that the Rating of Perceived Exertion is no greater than "strong," and Rating of Perceived Pain is no greater than "weak," during the exercise session;

Step 2: a cardiorom step comprising a plurality of short repeated bouts of aerobic exercise (0.5-2 minutes) followed by ROM exercise, wherein heart rate is continually within the training window, wherein the elements of step 2 are repeated over a period of between 30 and 90 minutes, and wherein step 2 is repeated until step 2 can be accomplished in "complete comfort," based on biofeedback, whereupon step 3 may then be undertaken Step 3: a cardiolift step lasting from 50 to 180 minutes, comprising an intense warm-up followed by alternating aerobic exercise and weightlifting exercise, wherein for the weightlifting exercise 5 to 20 weightlifting exercises are performed, using 3 or more sets per weightlifting exercise, and 1 to 20 repetitions per set followed by a ROM cool-down step.

BRIEF DESCRIPTION OF THE FIGURES

FIG. 1 shows an outline of a preferred embodiment of the invention.

FIG. 2 shows a sample Workout Log that can be used with the method of the invention at the advanced level. Comparable Workout Logs exist for the beginning and intermediate IBC workouts, and both prescribed logs (e.g., FIG. 2) and generic logs are available.

FIGS. 6A and 6B are graphs of muscle gained (A) and fat lost (B) by experimental and control subjects (females) during a ten-week training program. IBC (experimental subjects) produced more than twice the muscle gain and nearly three times the fat lost than the best conventional exercise prescription. FFM: Fat Free Mass.

FIGS. 9A, 9B and 9C show strength of the upper body (sum of one-repetition maxima for five exercises) after ten weeks of training in IBC (experimental subjects) (A) and the best conventional exercise prescription (Control) (B). There was no significant difference in the strength of the upper body between experimental subjects (IBC) and Controls (C).

DETAILED DESCRIPTION OF THE INVENTION

The invention is a unique method of physical exercise called Integrated Body Conditioning (IBC). The IBC method was developed using self-experimentation by the applicant as the primary developmental tool. The IBC method was tested by the applicant in controlled, randomized, and double-blind scientific experiments. These scientific studies demonstrated that IBC provides an astonishing and wholly unanticipated range of benefits in comparison with the best conventional exercise prescription. For the seven most important and generally accepted measures of exercise—efficacy strength, endurance, aerobic capacity, flexibility, body composition, energy system power, and enjoyment—the IBC method is one-fourth to three times more effective than the best conventional drug-free exercise regimen.

The Absence of Muscle Soreness with IBC

Perhaps the most important outcome of IBC, however, is that it avoids muscle soreness, unlike any other form of exercise ever discovered, researched, or published. Exercise-induced muscle soreness—technically termed Delayed Onset Muscle Soreness (DOMS)—typically starts a few hours after conventional exercise, and can become debilitating over the next 12-48 hours. It is such a serious problem for recreational exercisers and professional athletes alike that scientists have sought a cure for decades, trying everything from massage and cryotherapy to vitamin supplementation and fish oil. Until the discovery of IBC, nothing has worked. During and after IBC workouts, however, the level of DOMS is one-fifth to one-tenth the level reported during conventional exercise. Usually, exercisers experience no DOMS whatever.

IBC is the first and only exercise system discovered that virtually eliminates muscle soreness. Consequently, any exerciser can attain superior physical condition much faster and without discouraging and dangerous pain, and with much greater efficiency. The speed of IBC's training effects is useful to any exercise goal, but particularly valuable to athletes. Speed of training effects can be a matter of life or death in some professions, such as police, firefighters, emergency workers and first responders, and military personnel.

The Three Defining Elements of IBC

Figure 4:
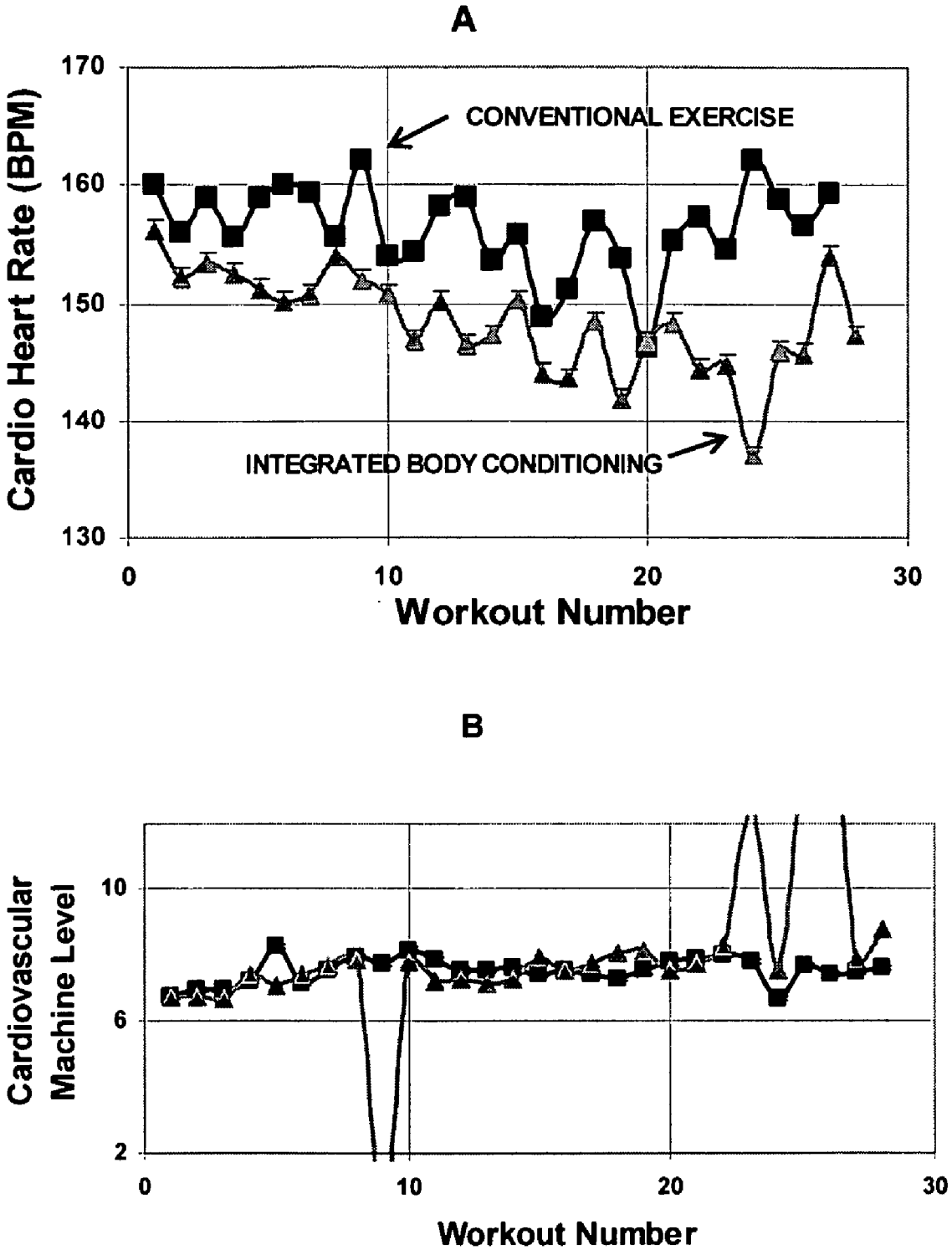
FIGS. 4A and 4B are graphs of mean heart rate (BPM) vs. Workout Number for experimental and control subjects (males) (A) and corresponding mean exercise intensities vs. Workout Number (B). Cardiovascular adaptation in subjects that did Integrated Body Conditioning (experimental subjects) was nearly three times faster than control subjects.

IBC is distinguished from all other approaches to exercise by three unique and defining elements. The first is integration of aerobics, resistance and Range of Motion (ROM) exercises into a single, convenient, and flexible workout. In the past, exercise professionals have advised against such integration, based on the theory that different forms of exercise interfere with the gains of each. In contrast, IBC integrates these diverse forms into a single workout, which dramatically facilitates the gains of each separate form of exercise. Cardiovascular adaptation, for example, takes place nearly three times faster during IBC in comparison with the best conventional exercise prescription (FIG. 4).

The second unique element of IBC is performance of resistance and ROM exercises while heart rate is elevated into a defined range, termed the heart rate "training window." The training window varies according to the exerciser's health, initial physical condition, and exercise goals. The training window is defined according to the intensity of exercise. The heart rate training window corresponding to moderate exercise is defined as (consensus among exercise professionals) 55% to 69% of the exercisers maximum heart rate (220 minus the exerciser's age). At the intermediate level of IBC, the intensity of prescribed exercise is vigorous, defined by exercise professionals as 70-89% of maximum heart rate, or 60-84% of a value called the Heart Rate Reserve (HRR). At the advanced level of IBC, the intensity of exercise is vigorous, defined as above using the HRR method. The Heart Rate Reserve is calculated by the Karvonen method, and is defined as maximum heart rate (220−age) minus resting heart rate multiplied by the boundary of vigorous exercise (0.6 for the lower boundary, 0.84 for the upper boundary) plus resting heart rate. The formulae are expressed as follows:

Heart rate reserve lower boundary=(heart rate max−heart rate resting)(0.6)+heart rate resting.

Heart rate reserve upper boundary=(heart rate max−heart rate resting)(0.84+heart rate resting.

The third unique element of IBC is progression in performance based on self-reported biofeedback, namely, heart rate, perceived exertion, and perceived pain. Perceived exertion is self-assessed by the exerciser using a well-established scale, the Rating of Perceived Exertion (RPE) scale, developed by Professor Gunnar Borg (and used with his permission). Perceived pain is likewise self-assessed by the exerciser, using Borg's Rating of Perceived Pain (RPP) scale (also used with his permission).

Progression within individual exercises, and overall exercise sessions, is advised under the IBC methodology if and only if the RPE is "strong" or less, and the RPP is "weak" or less. Otherwise, the exerciser repeats the same exercise intensity, workload, or workout in the following exercise session. Experience training college athletes shows that this formulaic method of regulating the rate of progression contributes to the fastest physical development of which the exerciser is genetically capable.

The 3-Step IBC Process

IBC is a three-step process (See FIG. 1). The first step (Cardio) is preparatory, aimed at attaining prerequisite aerobic conditioning. The purpose of this first step of IBC is to strengthen the cardiovascular and pulmonary systems to the point that Cardio-Driving is possible. The second step of IBC (Cardiorom) integrates aerobic exercise with ROM exercise. The purpose of this second step of IBC is to strengthen further the muscles, bones, and joints, and to maximize flexibility in support of subsequent strength training. The third step of IBC Cardiolift) is the first fully-integrated workout. The Cardiolift phase, which is fully integrated, alternates brief bouts of aerobic exercise to accelerate heart rate into the training window with a set(s) of resistance exercise (weightlifting), and is followed by a ROM cool-down to create a fully-integrated workout.

The Three Levels of IBC

As suggested above, IBC can be done at three levels—beginning, intermediate, and advanced. The appropriate level for each exerciser is different, depending on health, initial physical condition, and exercise goals. The three levels differ in both the intensity of exercise and the workload. At the beginning level, exercise is limited to moderate intensity physical activity, defined by generally-accepted convention as exercise at 55-69% of maximum heart rate, and workload is limited to one set each of a few basic resistance exercises, and 8-12 repetitions per set. In the Intermediate IBC workout, exercise is performed at vigorous intensity, defined by generally-accepted convention as 70-89% of maximum heart rate, with two set each of several resistance exercises and again 8-12 repetitions per set. In the Advanced IBC workout, exercise is performed at vigorous intensity, defined by generally-accepted convention as 60-84% of Heart Rate Reserve, with three or more sets of each resistance exercise. As a consequence of the increased workload and intensity at progressively higher levels, the duration of an IBC workout ranges from 30 minutes (beginning) through 60 minutes (intermediate) to 90 minutes or more (advanced IBC workout).

The Seven Principles of IBC

IBC is based on a unique combination of seven general principles, some of which are already well-known, and others of which are unique to IBC and integral to this Invention. 1) Integrated exercise. Aerobic, resistance and Range of Motion (ROM) exercises are incorporated into every workout. 2) Cardio-driving. Exercises are performed at a properly elevated heart rate, determined by starting level and exercise goals, calculated according to exercise intensity, and assessed continuously during workouts. 3) Body consciousness. Biofeedback is assessed continuously during workouts, using pulse rate and the Borg scales, and recorded using unique Workout Logs (See FIG. 2). 4) Progression. Rapid, steady growth is achieved formulaically, using perceived exertion (RPE) and perceived pain (RPP) to regulate the rate of progression. 5) Minimize pain. Pain is minimized, based on self-reporting using the RPP scale, to reduce the risk of injury and maximize gain. 6) Balance. IBC trains the whole body system using balance across muscles, joints, the three energy systems, the seasons, and a lifetime. 7) Mind-body connection. IBC joins mind and body into a single, indivisible system, using specific and unique methodologies, to maximize training effects.

Of these seven principles, four are unique to IBC: integrated exercise (1 above), Cardio-Driving (2 above), progression based on biofeedback (4 above), and minimization of pain during exercise (5 above). The remaining three principles (3, 6, and 7 above) are borrowed from other exercise traditions, particularly Eastern systems such as Yoga and the martial arts. IBC is therefore unique not only in the four new principles identified above, but also in their combination with the three principles that have been previously recognized and implemented in different training and exercise regimens.

IBC Workout Logs

The Workout Logs developed uniquely for IBC contain spaces for all the weights, repetitions, and biofeedback parameters on which basis progression is determined. The beginning, intermediate and advanced Workout Logs differ to accommodate the different parameters of the respective workouts. Although Workout Logs are a common tool in the exercise world, this particular Workout Log is unique to IBC. It contains spaces for recording cardiovascular and weight-lifting parameters, as well as perceived exertion (RPE) and two types of perceived pain (DOMS and "other" pain). DOMS, as noted above, is largely eliminated in IBC; the space for recording it is included both as a research tool and also as an indicator to the exerciser of whether the IBC routine is being implemented properly. As long as IBC is implemented correctly, the DOMS value recorded is typically zero.

These three measures of biofeedback (heart rate, RPE, RPP) are in turn used to determine the rate of progression form one workout to the next, as described above. A box at the bottom of the Workout Log enables the user to record overall workout parameters, including the time in the heart rate training window, the average heart rate during this time (which should fall into the range of the heart rate training window), the Kilocalories burned during the workout, and the amount of water consumed during the workout. The box at the bottom of the IBC Workout Log also contains a space for the exerciser to record the Rating of Perceived Exertion of the entire workout. If this RPE exceeds "strong," the exerciser repeats the same workout in the next exercise session (same weights and repetitions without progression). This process, unique to this Invention, is termed "gating." The IBC process of gating helps protect the exerciser from overtraining and depleting glycogen reserves dangerously ("bonking").

The Advantages of IBC

Figure 3:
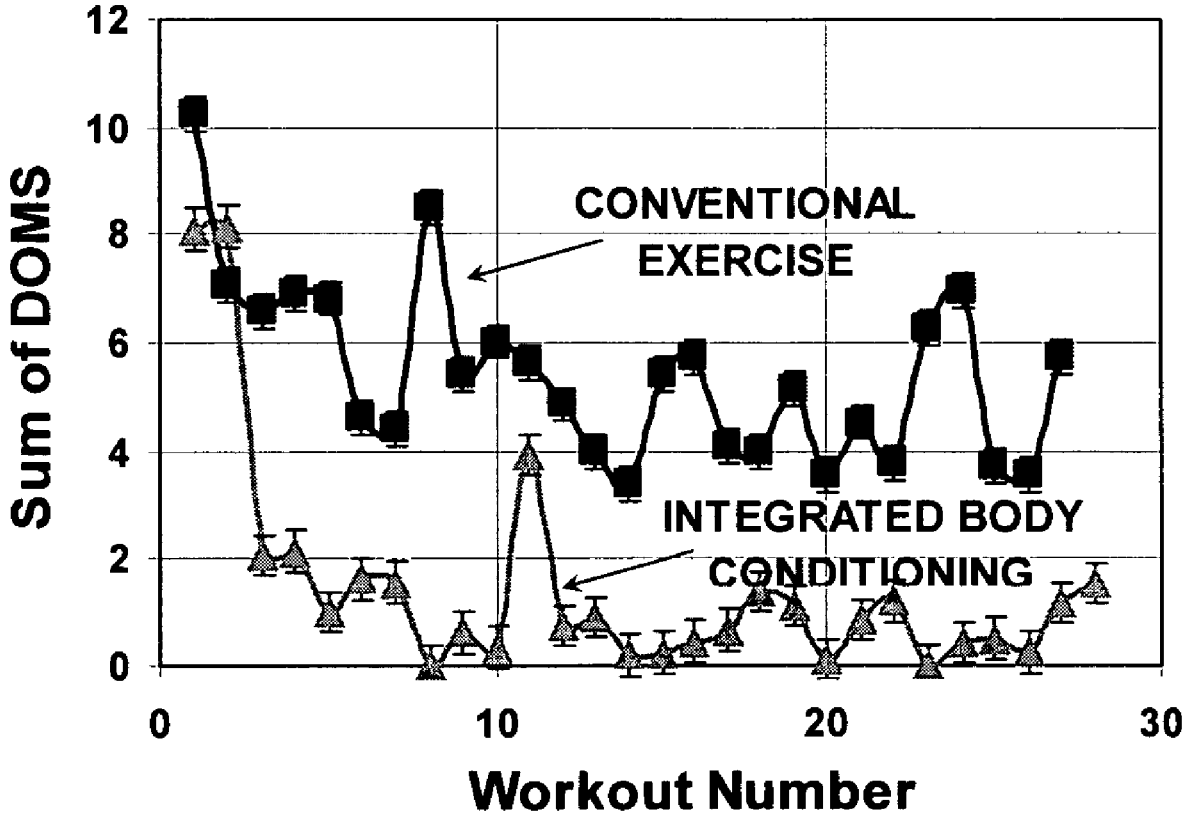
FIG. 3 is a graph of sum of self-reported Delayed Onset Muscle Soreness (DOMS) vs. Workout Number. Subjects who did Integrated Body Conditioning reported one-fifth to one-tenth the DOMS. Vertical bars=two standard errors of the population mean in all figures.

The IBC method of exercise has multiple, dramatic, and wholly unanticipated advantages over any other exercise system ever conceived or developed and systematically applied. These advantages are:

Muscle soreness is virtually eliminated (FIG. 3).

Cardiovascular adaptation—the steady decline in heart rate with increasing physical conditioning—is nearly three times faster than aerobics alone, documenting the biological synergy of training effects during IBC (FIG. 4).

Figure 5:
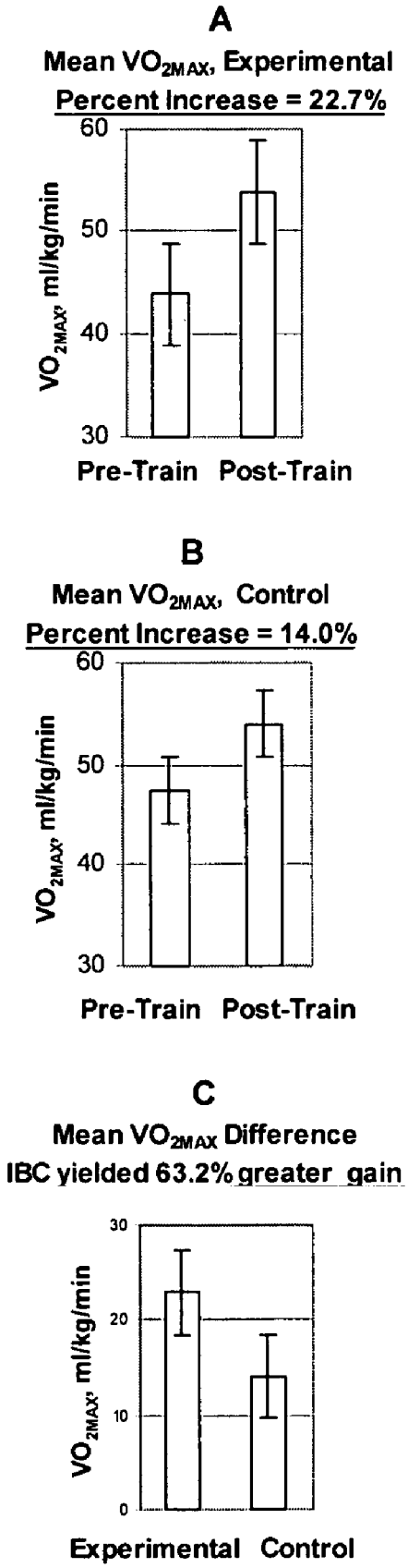
FIGS. 5A, 5B and 5C show aerobic capacity ($VO_{2MAX}$) of experimental (A) and control (B) subjects before (left column in each histogram) and after (right column) a ten-week training program. Integrated Body Conditioning (experimental subjects) increased $VO_{2MAX}$ nearly 70% more than the best conventional exercise prescription (C).

IBC results in a two-thirds faster increase in aerobic capacity ($VO_{2MAX}$) (FIG. 5).

IBC yields up to twice the muscle gain in comparison with the best conventional exercise (FIG. 6A).

IBC produces up to three times the fat loss as the best conventional exercise (FIG. 6B).

Figure 7:
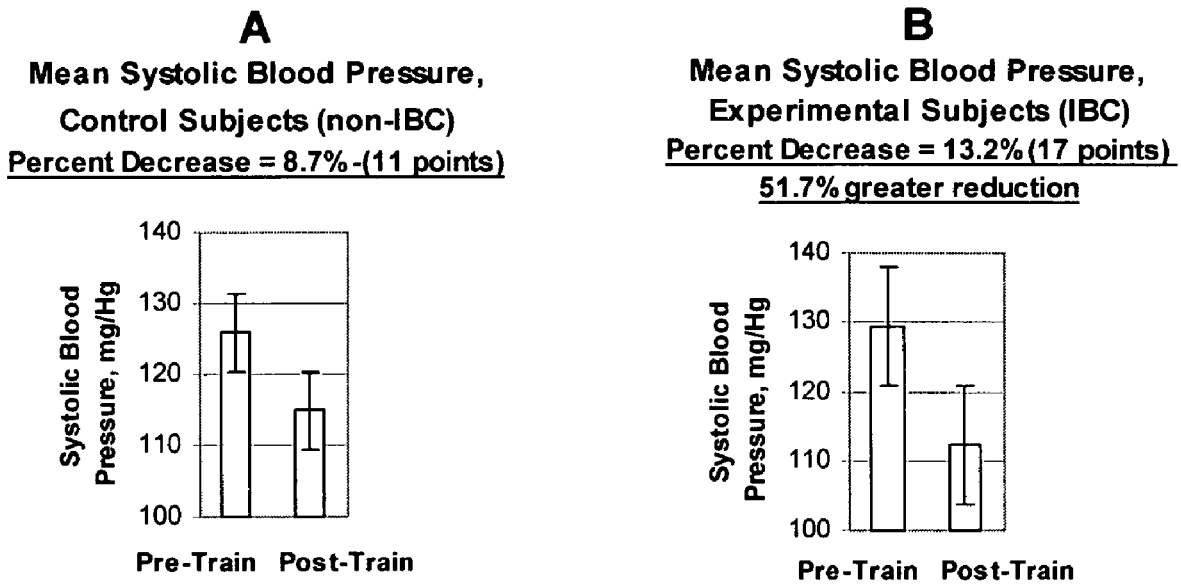
FIGS. 7A and 7B are graphs showing systolic blood pressure of control (A) and experimental (B) subjects before (left column in each histogram) and after (right column) a ten-week vigorous training program. Integrated Body Conditioning reduced systolic blood pressure more than 50% more in comparison with the best conventional exercise prescription.
Figure 8:
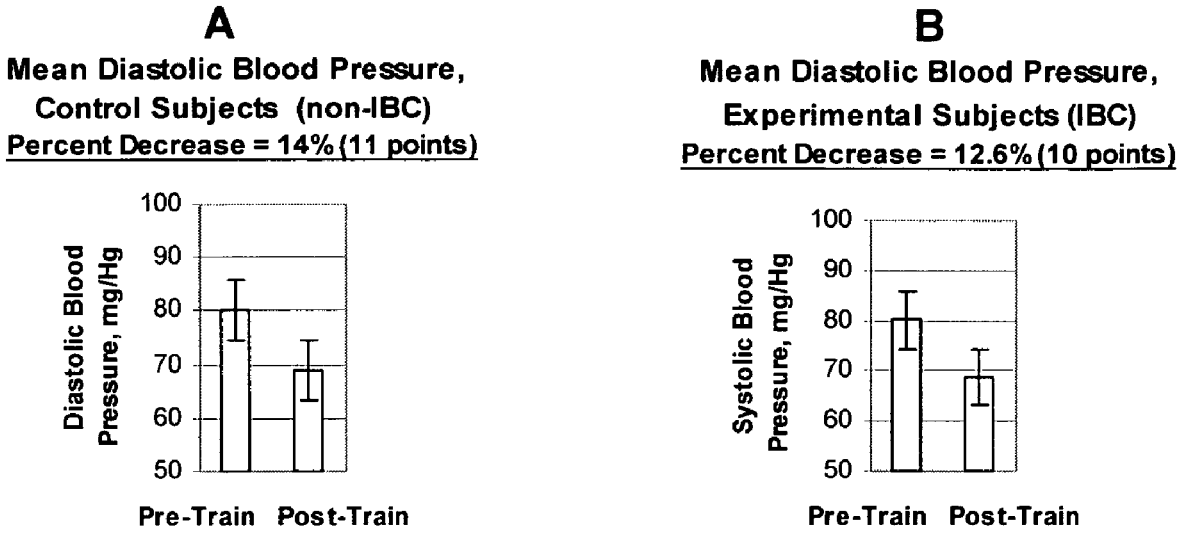
FIGS. 8A and 8B are graphs showing diastolic blood pressure of Control (A) and Experimental (B) female subjects before (left column in each histogram) and after (right column) a ten-week vigorous training program. Diastolic blood pressure dropped the same (about ten points) in both experimental and control subjects.

IBC results in 50% greater reduction in systolic blood pressure than the best conventional exercise (FIG. 7), although there was no difference in diastolic blood pressure changes (FIG. 8).

Figure 9:
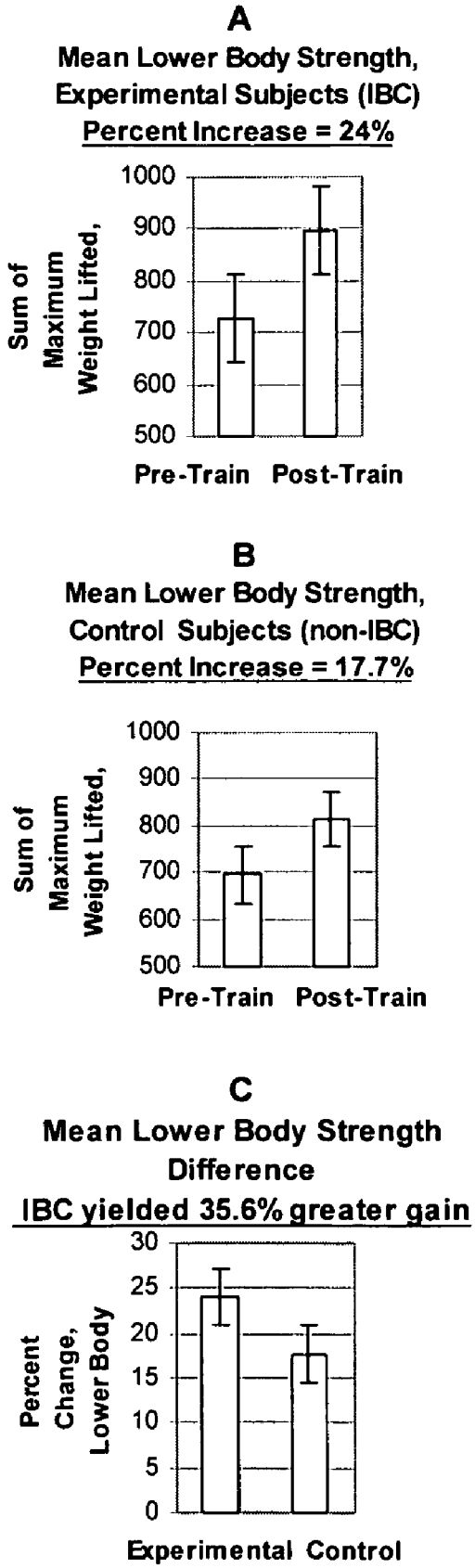
FIGS. 9A, 9B and 9C show strength of the lower body (sum of one-repetition maxima for three exercises, leg press, leg extension and leg flexion) after ten weeks of training in IBC (Experimental) (A) and the best conventional exercise prescription (Control) (B). IBC produced one-third greater strength gain in the lower body (C).

IBC enables a one-third greater increase in muscle strength (FIG. 9), although this training effect is limited to the muscles employed for cardio-driving (FIG. 10).

Figure 11:
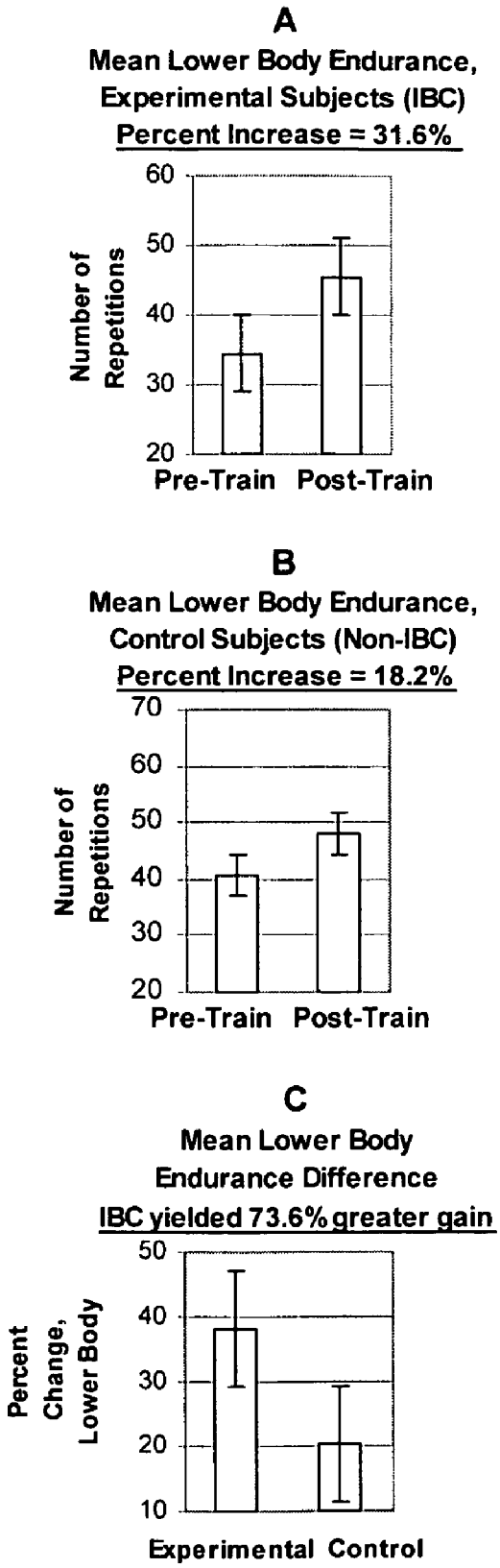
FIGS. 11A, 11B and 11C show strength of the lower body (sum of leg press repetitions at 50% 1-repetition maxima) after ten weeks of training in IBC (experimental subjects) (A) and the best conventional exercise prescription (Controls) (B). IBC produced a three-quarter greater endurance gain in the lower body (C).
Figure 12:
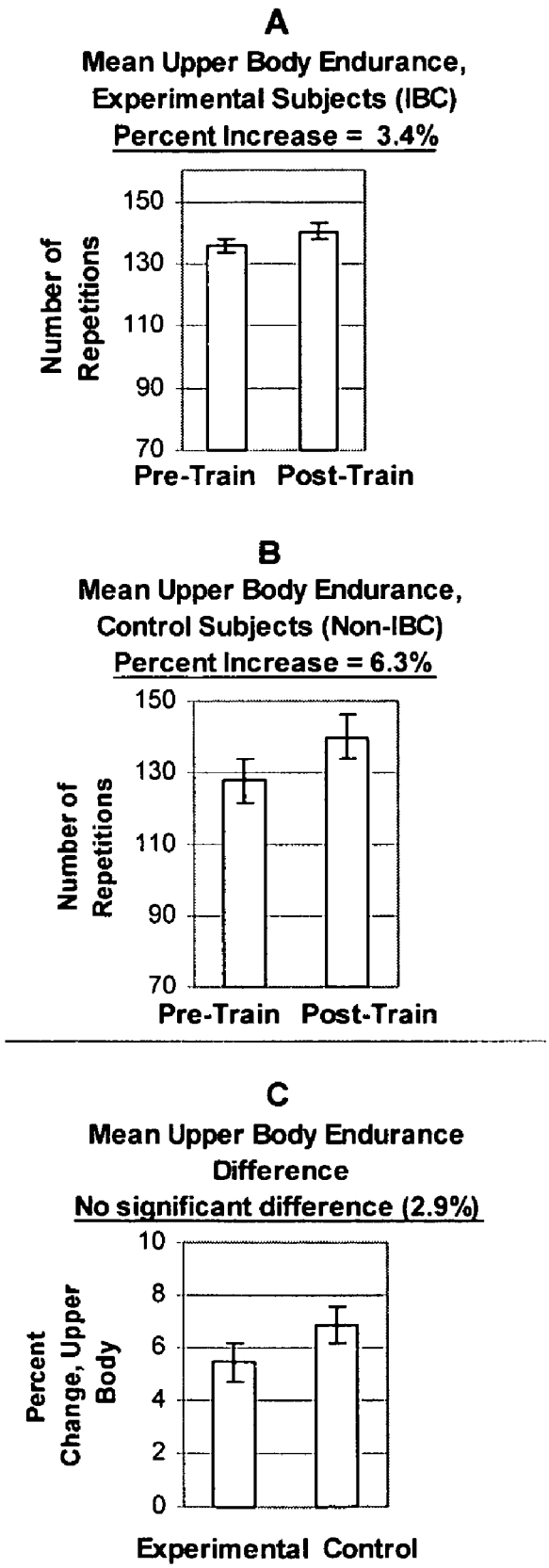
FIGS. 12A, 12B, and 12C show endurance of the upper body (sum of repetitions at one-repetition maxima for five upper body exercises) after ten weeks of training in IBC (experimental subjects) (A) and the best conventional exercise prescription (control subjects) (B). There was no significant difference in the endurance between experimental and control subjects (C).

IBC provides a three-quarter greater increase in muscle endurance (FIG. 11), although again, this training effect of IBC is confined to the muscles employed in cardio-driving (FIG. 12).

Figure 13:
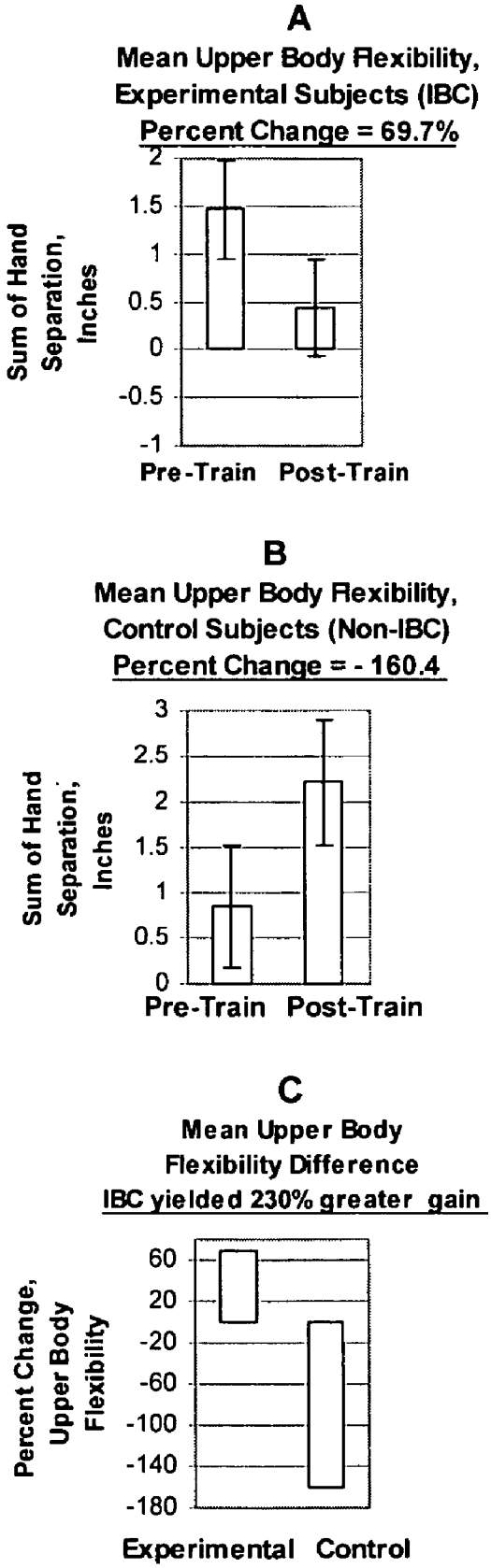
FIGS. 13A, 13B, and 13C show flexibility of the upper body (distance between fingertips in the shoulder flexibility test) after ten weeks of training in IBC (experimental subjects) (A) and the best conventional exercise prescription (control subjects) (B). IBC produced a 230% greater gain in upper body flexibility (C).

IBC produces more than twice the flexibility gain in the upper body (FIG. 13).

Figure 14:
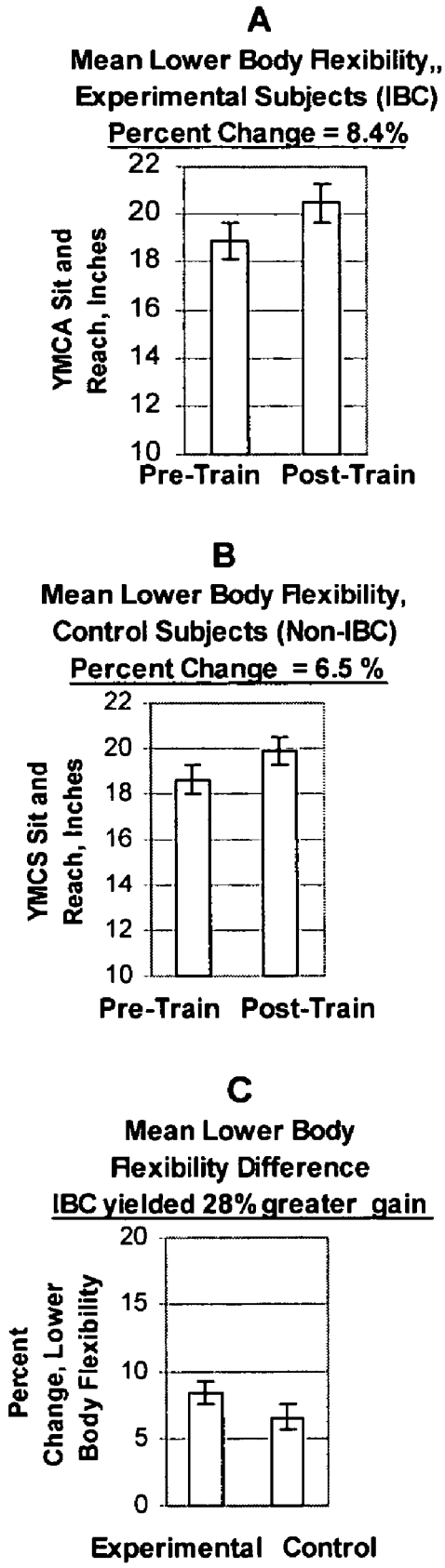
FIGS. 14A, 14B, and 14C show flexibility of the lower body (YMCA sit-and-reach test) after ten weeks of training in IBC (experimental subjects) (A) and the best conventional exercise prescription (control subjects) (B). IBC produced a one-fourth greater gain in lower body flexibility (C).

IBC produces a one-fourth greater flexibility gain in the lower body (FIG. 14).

Figure 15:
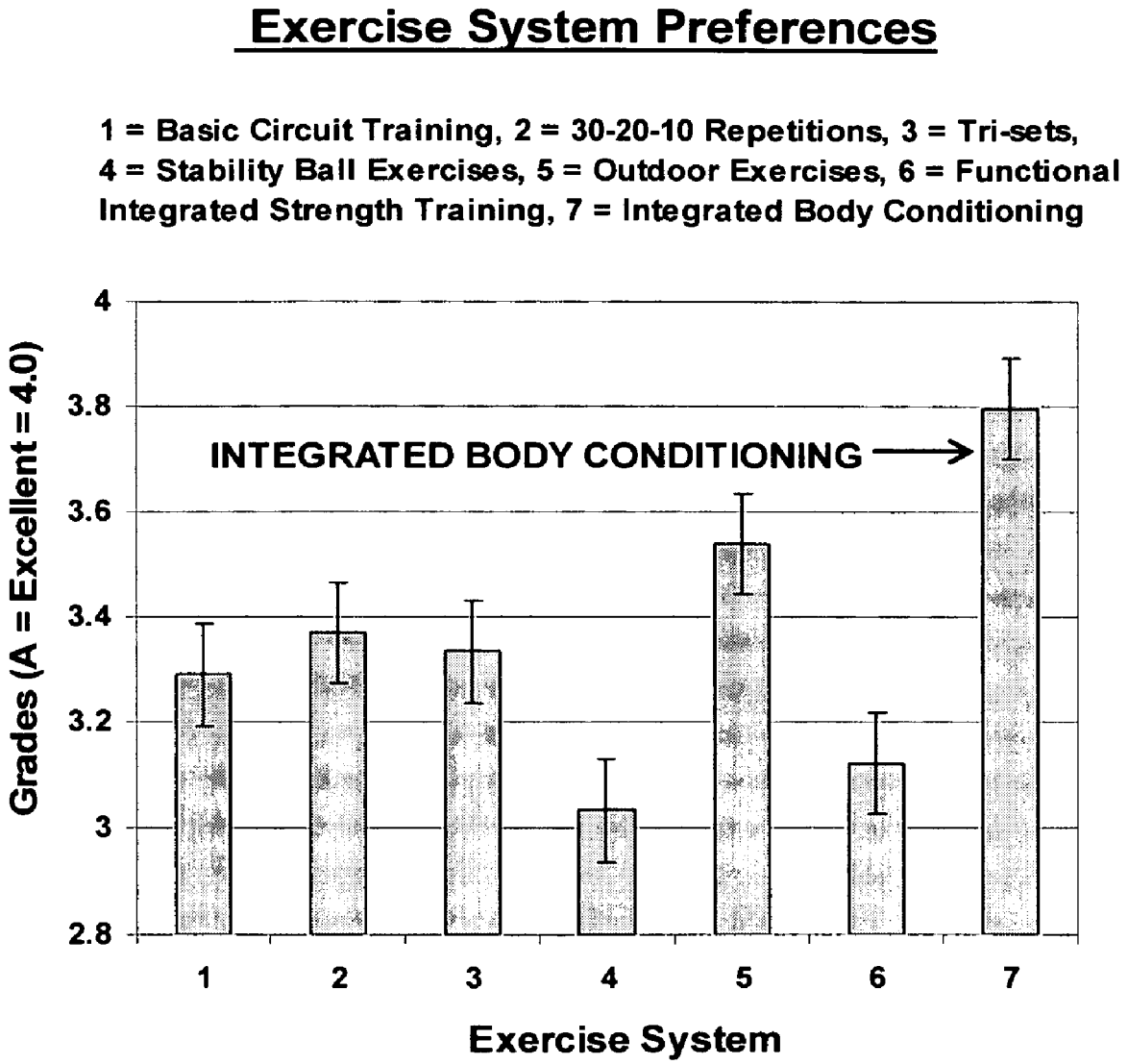
FIG. 15 shows a histogram of exercise preferences in deconditioned college students among seven different exercise regimens in which they were trained. IBC was preferred above all other exercise regimens

IBC is more fin (FIG. 15). Exercisers tested for preferences in six conventional exercise regimens consistently preferred IBC. Exercise enjoyment is in turn critical to exercise initiation, progression, and long-term adherence.

Scientific Testing of the Invention

As noted above, IBC was developed initially through years of self-experimentation with exercise methodologies by the applicant. After the IBC methodology and IBC Workout Logs were fully conceived, developed, and put into practice, the applicant initiated and directed a series of collaborative scientific studies at the University of California, Santa Cruz (UCSC). These experiments aimed at testing the efficacy of IBC in comparison with the best conventional exercise prescription, and were conducted in collaboration with Dr. Daniel T. Wood, Executive Director of the Office of Physical Education, Recreation, and Sports (OPERS), Mr. Ryan Andrews, a doubly-certified physical trainer who directs the OPERS Wellness Center (including its world-class gymnasium), and Dr. Les Elkind, M. D., director of the University's Student Health Services.

We did two separate scientific experiments with volunteer student-athletes at UCSC. The first experiment was with 32 women athletes, comprising members of the soccer and volleyball teams. The second experiment was with 22 male athletes of the University's soccer and swim teams. Both of these scientific experiments were conducted using a controlled, randomized, and double-blind experimental protocol. In each case, subjects were matched initially for muscle strength, muscle endurance, and aerobic capacity ($VO_{2MAX}$), and divided using a random procedure into two groups, experimental and control, with equal numbers of subjects. The experimental group did the IBC workout. The control group did the same exercises, initially at the same intensity (50% of one-repetition maximum weight for the women, 65% of maximum for the men), and initially at the same number of sets (3) and repetitions (8). Both groups exercised at the same time of day (6-10 AM) on the same days (Tu, Th, Sa), on different floors of the same gymnasium.

Experimental subjects exercised at an elevated heart rate, achieved by brief (1-minute) bouts of cardio-acceleration between weightlifting exercises. Members of the control group, in contrast, rested between exercises to keep their heart rate low, and then did additional aerobic exercise at the end of their weightlifting session to balance the total volume of aerobic exercise across the two groups. Both groups employed the other two unique elements of IBC, i.e., they integrated different forms of exercise into the same workout, and progressed according to biofeedback as described above. Therefore, our scientific tests were deliberately limited to just one of the three elements of IBC, elevated heart rate during resistance training. Such limitation of scientific testing to a single independent variable is essential to avoid ambiguity in interpreting causal effects.

Both experiments, on the male and the female student-athletes, were approved and overseen by the University's Institutional Research Board, Human Subjects Research Committee, to ensure compliance with relevant state and federal legislation and policies, including the Health Insurance Portability and Accountability Act (HIPPA). All subjects were risk-stratified for coronary artery disease factors following the methodology of the American College of Sports Medicine to ensure their safety, and every subject signed an informed consent form explaining the procedures, risks, and benefits of the experiment, and informing them that they could quit the experiment at any time without prejudice (fewer than 10% did). Both groups were also informed that the results of the study, if positive, would be published.

To test subjects, we made more than 100 separate measurements on every subject in both groups, experimental and control, before and after the respective training program. We also recorded dozens of measures of every workout for each athlete, including self-assessed DOMS and other pain, using the scales and Workout Logs described above. The results of these experiments astounded even those of us who already did IBC regularly, and are summarized in FIGS. 3-15 below. As noted above, the results show that IBC (experimental group) is from one-fourth to three times as effective as the best conventional exercise regime (control group) that we could design. It is on this basis that these experiments proved IBC to be unexpectedly and vastly superior to the best conventional exercise prescription.

In a separate experiment on 30 deconditioned college students (two-thirds female) who enrolled in a beginning physical education class at UCSC, we explored the enjoyment factor for IBC. Most of these subjects had never exercised before, and hence this group represents a good cross section of young people who are new to exercise. We trained these 30 students in seven different exercise programs, including indoor (gym-based) IBC. At the end of the quarter, after learning and doing the seven exercise programs, the student subjects graded each program using the A-F scale. IBC won this competition handily (FIG. 15), showing that of these seven exercise approaches, IBC was by far the most fun for these exercisers.

EXAMPLES AND EMBODIMENTS OF IBC

The gym-based IBC method described above is only one of several forms that IBC can take. In addition, several outdoor, home, and other IBC workouts have been designed and implemented. These examples and variants of IBC use the same methodology and Workout Logs, and incorporate the same three elements, the same 3-step process, and the same seven principles of IBC described above. Some of these are described in this section to illustrate the tremendous flexibility and adaptability of the IBC methodology.

The Gym-Based IBC Workout

To illustrate the IBC methodology, we here describe the details of the beginning, intermediate, and advanced gym-based IBC programs. These are similar in form and content to the additional variants of IBC described below, including the outdoor, home, lunchtime, sport-specific, and rehabilitation IBC workouts. All of these variants share the following generalities, which together define the uniqueness of IBC.

Application of the three essential elements of IBC (integrated exercise, elevated heart rate, progression based on biofeedback)

The 3-step process by which the exerciser progresses to the fully-integrated IBC workout (i.e., cardio, cardiorom, cardiolift)

Application of the seven principles of IBC detailed above (integrated exercise, cardio-driving, body consciousness, progression, minimize pain, balance, mind-body connection)

The Beginning IBC Gym Workout

Beginning IBC is for first-time exercisers and those who have not exercised during the preceding six months. Prerequisites include the absence of symptoms for coronary artery disease, and the presence of no more than two of the generally-accepted risk factors for coronary artery disease. Because the intensity of the beginning IBC workout is moderate, medical clearance and a doctor-supervised exercise test are not necessary.

Step 1: Cardio (Preparatory)

The goal is 30 minutes of moderate, self-paced aerobic exercise, completed in complete comfort. "Complete comfort" is defined on the basis of self-assessed biofeedback, and requires that the Rating of Perceived Exertion is no greater than "strong," and Rating of Perceived Pain is no greater than "weak," during the exercise session. The exact method of heart rate elevation during this cardio phase is not critical—any aerobic exercise that elevates heart rate into the training window defined above is adequate, including machines such as the treadmill, stair stepper, elliptical trainer, stationary cycle, or rowing machine. Alternatively, the exerciser can do conventional calisthenics such as jumping jacks or jogging in place, step aerobics, jump rope, etc. Any aerobic exercise that elevates heart rate into the training window and keeps it there for the duration of the workout is acceptable. Workouts can occur every day, but the minimum is three workouts per week. The cardio phase of the beginning IBC workout lasts from one to four weeks, depending on the exerciser's initial physical condition, exercise goals, motivation, and the frequency of workouts.

Step 2: Cardiorom (Partially Integrated)

In the cardiorom phase, short bouts of aerobic exercise (0.5-2 minutes) are alternated with bending and stretching exercises. Heart rate is elevated into the training window using the exerciser's choice of aerobic exercise (machines, calisthenics, etc.), followed immediately by performance of a ROM exercise. This sequence is continued through several (5-10) ROM exercises, for about 30 minutes (±10 minutes). When this phase can be accomplished in "complete comfort," based on biofeedback as described above, the exerciser progresses to the next phase. The cardiorom phase may last from one to four weeks, depending again on the exerciser's initial physical condition, exercise goals, motivation, and workout frequency.

Step 3: Cardiolift (Fully Integrated)

In this final phase of the IBC sequence, the exerciser first warms up for a few minutes, and then alternates cardio exercise with weightlifting exercises, following the pattern of the cardiorom phase described above. In the beginning IBC workout, one set each of five to seven weightlifting exercises are performed, using 3-15 repetitions per set (fewer for strength and power development, more for endurance). A typical value for the range of repetitions is 8-12. Each cardiolift session is followed by a ROM cool-down, using the same bending and stretching exercises as in the cardiorom phase, but with no interpolated aerobic exercise. The cardiolift phase can last indefinitely. After a few months, however, cross-training and/or periodization are recommended, or graduation to the intermediate IBC workout. It should be noted that the Workout Logs designed for IBC apply only to the third phase, the fully-integrated cardiolift workout, although these logs can be used also to record cardio and cardiorom data.

The Intermediate IBC Gym Workout

The intermediate IBC workout is for individuals who have exercised continuously for the past six months and are in correspondingly good physical condition. Because this level of the IBC workout entails vigorous exercise, the safety standards for undertaking the intermediate IBC workout are more stringent. They require not only the absence of symptoms of coronary artery disease, but also no more than one of the generally-accepted risk factors of coronary artery disease, as established by the American College of Sports Medicine. The intermediate IBC workout consists of the same three steps as the beginning IBC workout, but differs in the goals, intensity of exercise, duration of workouts, and the corresponding exercise volume.

Step 1: Cardio (Preparatory)

The goal is 50 minutes of vigorous aerobic exercise in "complete comfort," as defined above based on the Rating of Perceived Exertion and the Rating of Perceived Pain. All further specifications are as in the beginning IBC workout, cardio phase, as described above.

Step 2: Cardiorom (Partially Integrated)

The goal is a longer workout—from 40 to 60 minutes—in which aerobic and ROM exercises are alternated. All further details are as in the beginning IBC workout, cardiorom phase, as described above.

Step 3: Cardiolift (Fully Integrated)

The goal is a workout that lasts approximately 60 minutes (±10 minutes), begins with a warm-up, proceeds to alternating aerobic and resistance exercise, and terminates with a ROM cool-down. The exerciser performs two rather than one set of weightlifting exercises, uses six to nine weightlifting exercises, and adjusts the number from 3-15, depending on exercise goals. All other details of the intermediate cardiolift are the same as for the beginning cardiolift described above.

The Advanced IBC Gym Workout

Advanced IBC requires, as a prerequisite, that the exerciser is in excellent general physical condition, and that application of the risk-stratification procedure of the American College of Sports Medicine reveals no more than one risk factor for coronary artery disease. Other medical steps are recommended, but not required, including a physician-supervised exercise test. The preferred embodiment of the 3-step advanced IBC program (FIG. 1) has three main steps, or stages, just like the beginning and intermediate IBC workouts. These steps are cardio, cardiorom, and cardiolift.

Step 1: Cardio (Preparatory)

The goal is 60 minutes of vigorous aerobic exercise (±10 minutes), conducted in "complete comfort" based on the Rating of Perceived Exertion and Rating of Perceived Pain. Heart rate must not exceed the upper boundary of the heart rate training window, calculated as described above using the maximum heart rate method or, preferably, the Heart Rate Reserve method. All further details are as described above for the beginning and intermediate cardio phases of the IBC workout. People who are in good initial physical condition may require no more than a week in the cardio phase, while others may require as long as a month before graduating to the cardiorom phase. In other embodiments of the advanced IBC workout, the duration of the cardio phase may range from 20 to 120 minutes. For example, in some embodiments, the exercise duration may be 30, 40, 50, 60, 70, 80, or 90 minutes.

Step 2: Cardiorom (Partially Integrated)

The goal again is integration of ROM exercises with prolonged vigorous cardio exercise. "Prolonged" is defined as 60 minutes in the preferred embodiment, but the duration may vary in other embodiments from 30-90 minutes, depending on the exerciser's goals and motivation, as well as the frequency of workouts. For example, in other embodiments, the duration of the cardiorom phase may be 30, 40, 50, 70, 80, or 90 minutes. The exact type of ROM exercises used is unimportant at all levels of the cardiorom phase, beginning, intermediate and advanced. Exercisers may choose their own sequence, follow a sport-specific routine, or even make up their own ROM exercises. All that matters is that the exerciser's heart rate is elevated into the calculated training window during stretching and bending.

Step 3: Cardiolift (Fully Integrated)

The advanced cardiolift begins with the "heat-up," a period of prolonged aerobic exercise that is, in the preferred embodiment, 30 minutes in duration. In other embodiments, the heat-up may last 20, 40, or 50 minutes. The goal of the advanced cardiolift is integration of weightlifting with alternated vigorous aerobic exercise, as in the intermediate and beginning levels. The method is again alternate aerobic and resistance exercise (weightlifting), followed by a ROM cool-down. In the preferred embodiment (FIG. 2), the duration of the cardiolift phase is 90 minutes, sufficient time for nine or ten different resistance exercises, three sets each, from 8-12 repetitions. The exact duration of the IBC cardiolift can vary, however, all the way up to 2.5 or 3 hours. In this case, more weightlifting exercises are possible—from nine or ten to 20 or more. The exact weightlifting exercises that are used are a matter of the exerciser's discretion, and can be tailored to specific sports for athletes. Again, the number of sets can be varied according to the exerciser's physical condition, goals, and motivation, from three to five or more. The weights used can remain the same for all sets, or change upward or downward, again depending on preferences and exercise goals. The number of repetitions likewise may very from 8-12 (preferred embodiment, FIG. 1), but from 3-15 depending on the exerciser's goals. The cardiolift phase can continue indefinitely for several months to cross-training, periodization, or taper into a sport season, depending on the exercisers goals.

To illustrate some of the variation that is possible in the context of the gym-based IBC workout, the exerciser may use during the cardiolift stage exercise machines such as a leg press machine, a leg extension machine, pull-down machine, etc. Alternatively, however, the exerciser may choose to use free weights rather than machines—barbells and dumbbells of appropriate weight. In yet another variation, the exerciser may use body weight for resistance, as in push-ups, sit-ups, and free squats. The exact form of the resistance exercise is immaterial; all that matters to harvest the accelerated training effects of IBC is that different modes of exercise are integrated into the same workout, resistance exercises are done with a properly elevated heart rate, and progression from one workout to the next is regulated according to biofeedback as detailed above.

Workout Logs

For each level of IBC workout, beginning, intermediate, and advanced, two special Workout Logs have been designed, the prescribed and the generic. FIG. 2 illustrates the prescribed Workout Log for the advanced IBC workout. In the prescribed log, individual weightlifting exercises are prescribed to attain a balanced overall workout. In the generic log, the spaces for identifying weightlifting exercises are left blank so that the exerciser may choose these exercises according to their own interests or exercise goals. Similar unique Workout Logs have been designed for the beginning and intermediate IBC workouts.

Each stage of the IBC workout has a corresponding box in the Workout Log in which to record relevant workout data and biofeedback. During the cardio phase (top box in FIG. 2), parameters of the warm-up or heat-up are recorded so that the exerciser may follow cardiovascular development over time. During the cardiolift phase (middle box in FIG. 2), the weight, number of sets, and number of repetitions of each exercise are recorded. There are also spaces provided for recording the self-assessed Rating of Perceived Exertion (RPE) for each weightlifting exercise, as well as the self-assessed Rating of Perceived Pain for the same exercise. These values are then used to determine whether or not to progress in weight or repetitions for that weightlifting exercise in the next workout. Any increase in weight or repetition for the next workout is circled as an "advance." The number of advances per workout, and changes in this value over time, provide an indicator of the exerciser's progression. Any such individual advances are accepted, however, only if the Rating of Perceived Exertion for the whole workout (bottom box) is "strong" or less. This procedure embodies the IBC method of progression and at the same time implements the process of gating as detailed above.

The Outdoor IBC Workouts

Included in the outdoor IBC workouts are the beach, river, and mountain IBC workouts, to name but three. In the beach workout, for example, cardio-acceleration is achieved by walking or jogging on dry sand, and resistance exercises are performed using PowerBlock portable dumbbells carried by the exerciser in a day pack. In the river workout, stationary swimming against a swift current provides cardio-acceleration, while in the mountain workout, cardio-acceleration is achieved by rapid hiking, climbing, or mountain biking, interpolated with resistance exercise. In all cases, the outdoor cardiolift workouts are preceded by a warm-up (beginning and intermediate levels) or the heat-up (advanced level), and followed by a ROM cool-down. We note these variants of the IBC exercise method in this application to illustrate the breadth and depth, and universal applicability, of the IBC method of exercise.

Sport-Specific IBC Workouts

Several sport-specific IBC workouts have been designed and implemented, including workouts for the sports of soccer, basketball, and golf. The general approach to these sport-specific IBC programs is to use the advanced IBC workout to build foundational strength and endurance, and then to identify the muscles and movements most important to the sport and train them using the IBC methodology. The law of specificity, which states that training effects are specific to the exercise that creates them, requires that the sport is practiced for skill development and physical conditioning tailored exactly to the sport. These sport-specific workouts document examples and variants of IBC, and illustrate the tremendous flexibility of the IBC approach.

The Rehabilitation IBC Workout

Deconditioned seniors and patients rehabilitating from serious illnesses such as a heart attack can do the Rehabilitation IBC workout, but only with the approval of the exerciser's physician, and under the supervision of the physician or a trained physical therapist. The rehabilitation IBC workout is designed for performance at home using no more than a kitchen table and chair, wall, and broom. The rehabilitation workout is divided into three segments, lower body, upper body, and core, each of which lasts 15 minutes.

For the lower body Rehabilitation IBC workout, the exerciser begins by taking the pulse. The exerciser then warms up by marching in place, supporting body weight with one hand on a kitchen table, or assisted by the supervising therapist, until the heart rate enters the moderate intensity window (approximately 75-95 beats per minute, depending on the exercisers age and exercise prescription). While the heart rate is elevated from marching in place, the exerciser performs leg extension and flexion, chair squats, sideways leg movements (hip abduction and adduction), and toe-raises.

The upper body Rehabilitation IBC workout uses the same general approach—elevate the heart rate by marching in place or squatting repeatedly using a kitchen chair, and perform push-outs from a wall, an overhead press with a broom, forward arm raises, lateral arm raises, and shoulder shrugs. The core workout uses the same IBC approach, with five core exercises—lying abdominal curls, lying straight leg raises, lying back bridges, standing belly sucks, and standing but tucks. The initial goal of the Rehabilitation IBC workout is to exercise 30 minutes per day, using two of the three sets of exercises described above, and alternating sets on different days to ensure a balanced, full-body workout.

SUMMARY

The present disclosure describes a new method of exercise called Integrated Body Conditioning (IBC), in which different modes of exercise (aerobic, resistance, ROM) are integrated into every exercise session, every exercise is performed at a properly elevated heart rate, and progression from one exercise session to the next is based on self-assessed and measured biofeedback. A unique, unprecedented and highly beneficial effect of IBC is the virtual absence of muscle soreness (FIG. 3). The training effects of IBC range from one-fourth to up to three times better than the best previous conventional exercise system (FIGS. 4-15). Although some elements of IBC appear in some sports and previous exercise approaches, the combination of elements, the steps, and the principles of IBC have never been systematically described or used. Neither have training effects as dramatic as the ones discovered using IBC been obtained from any other drug-free approach to exercise. The IBC workout can be done at any level, from beginning to advanced, in virtually any location. Variants and examples of IBC that have been implemented include gym, outdoor, home, lunchtime, sport-specific, and rehabilitation IBC workouts.

The embodiments disclosed in this document are illustrative and exemplary and are not meant to limit the invention. Other embodiments can be utilized and structural changes can be made without departing from the scope of the claims of the present invention. The present invention encompasses all embodiments and variations claimed and all equivalents thereof. As used herein and in the appended claims, the singular forms "a," "an," and "the" include plural reference unless the context clearly dictates otherwise.

What is claimed is:

1. For a human subject, a method for beginning level exercise comprising performing the following steps, in sequence:

Step 1: a cardio step comprising between 20 to 40 minutes of moderate aerobic exercise completed in complete comfort, wherein "complete comfort" is defined on the basis of self-assessed biofeedback;

Step 2: a cardiorom step comprising a plurality of short repeated bouts of aerobic exercise of from 0.5 to 2 minutes duration, each followed by a range of motion exercise, wherein heart rate is maintained within the training window, wherein the elements of step 2 are repeated over a period of between 20 and 40 minutes, and wherein step 2 is repeated until step 2 can be accomplished in "complete comfort," based on biofeedback, whereupon step 3 may then be undertaken;

Step 3: a cardiolift step comprising a warm-up followed by between 20 and 40 minutes of alternating aerobic exercise and weightlifting exercise, wherein heart rate is maintained within the training window, wherein for the weightlifting exercise 1 to 8 weightlifting exercises are performed, using 1 or more sets per weightlifting exercise, and 1 to 20 repetitions per set; and a ROM cool-down.

2. The method of claim 1 wherein aerobic exercise is performed using a device selected from the group consisting of: a treadmill, a stair stepper, an elliptical trainer, a stationary cycle and a rowing machine.

3. The method of claim 1 wherein aerobic exercise performed using a method selected from the group consisting of: callisthenics, step aerobics, jogging, running, cycling, climbing, rowing, and swimming.

4. The method of claim 1 wherein, in step 3, each set of weightlifting exercises is performed between 8 and 12 times.

5. The method of claim 1 further comprising at least one step performed outdoors.

6. The method of claim 1 wherein biofeedback measurements are recorded using a Workout Log.

7. For a human subject, a method for intermediate level exercising comprising performing the following steps, in sequence:

Step 1: a cardio step comprising between 30 to 50 minutes of vigorous aerobic exercise completed in complete comfort, wherein "complete comfort" is defined on the basis of self-assessed biofeedback;

Step 2: a cardiorom step comprising a plurality of short repeated bouts of aerobic exercise of from 0.5 to 2 minutes duration, each followed by a range of motion exercise, wherein heart rate is maintained within the training window, wherein the elements of step 2 are repeated over a period of between 40 and 60 minutes, and wherein step 2 is repeated until step 2 can be accomplished in "complete comfort," based on biofeedback, whereupon step 3 may then be undertaken;

Step 3: a cardiolift step lasting from 50 to 70 minutes, comprising a warm-up followed by alternating aerobic exercise and weightlifting exercise, wherein heart rate is maintained within the training window, wherein for the weightlifting exercise 8 to 12 weightlifting exercises are performed, using 2 or more sets per weightlifting exercise, and 1 to 20 repetitions per set; and a ROM cool-down.

8. The method of claim 7 wherein biofeedback measurements are recorded using a Workout Log.

9. For a human subject, a method of advanced level exercise comprising performing the following steps, in sequence:

Step 1: a cardio step comprising between 50 to 70 minutes of vigorous aerobic exercise completed in complete comfort, wherein "complete comfort" is defined on the basis of self-assessed biofeedback;

Step 2: a cardiorom step comprising a plurality of short repeated bouts of aerobic exercise of from 0.5 to 2 minutes duration, each followed by a range of motion exercise, wherein heart rate is maintained within the training window, wherein the elements of step 2 are repeated over a period of between 30 and 90 minutes, and wherein step 2 is repeated until step 2 can be accomplished in "complete comfort," based on biofeedback, whereupon step 3 may then be undertaken;

Step 3: a cardiolift step lasting from 50 to 180 minutes, comprising an intense warm-up followed by alternating aerobic exercise and weightlifting exercise, wherein heart rate is maintained within the training window, wherein for the weightlifting exercise 5 to 20 weightlifting exercises are performed, using 3 or more sets per weightlifting exercise, and 1 to 20 repetitions per set; and a ROM cool-down.

10. The method of claim 9 further comprising cross-training, periodization or taper exercises.

11. The method of claim 9 wherein biofeedback measurements are recorded using the Workout Log as shown in FIG. 2.

* * * * *